US005097539A

United States Patent [19]

Tchorbadjian

[11] Patent Number: 5,097,539

[45] Date of Patent: Mar. 24, 1992

[54] HYGIENIC SPRAY APPARATUS INTEGRAL WITH TOILET

[76] Inventor: Virginia K. Tchorbadjian, 1603 Plainfield Pk., Johnston, R.I. 02919

[21] Appl. No.: 559,256

[22] Filed: Jul. 30, 1990

[51] Int. Cl.[5] ..... A47K 3/20; A47K 3/22

[52] U.S. Cl. ..... 4/420.5; 4/420.4; 4/443

[58] Field of Search ..... 4/420.1, 420.2, 420.3, 4/420.4, 420.5, 448, 443, 444, 445, 446, 447, 420, 656

[56] References Cited

FOREIGN PATENT DOCUMENTS

| | | | |
|---|---|---|---|
| 48108 | 2/1981 | France | 4/420.4 |
| 48402 | 2/1984 | France | 4/420.4 |
| 766508 | 2/1955 | United Kingdom | 4/568 |

*Primary Examiner*—Henry J. Recla
*Assistant Examiner*—David J. Walczak
*Attorney, Agent, or Firm*—M. Lawrence Oliverio

[57] ABSTRACT

An improved hygienic spray apparatus for use in connection with a toilet bowl comprising a crescent-shaped shelf integrally protruding from the forward right hand side of a toilet bowl, the shelf and the bowl comprising a unitary body; the toilet bowl comprising a main bowl portion for holding water therein supplied by a first source of water, the main bowl portion having an open top for receiving waste therethrough into the water; the shelf having an aperture in a top surface thereof for mounting a water spray mechanism therein, the water spray mechanism being connected to one end of a flexible hose, the other end of the hose being connected to a second source of water; the shelf forming an enclosed chamber around the outside surface of the main bowl portion of the toilet bowl; the shelf being disposed on the right hand side of the bowl below the rim of the open top such that the water spray mechanism is readily manually accessible by a person sitting over the main bowl for ready removal from the mounting aperture and ready insertion back into the aperture; the hose being readily slidable through the mounting aperture during manual removal and insertion of the water spray mechanism, the chamber enclosably storing the hose out of sight when the water spray mechanism is mounted within the mounting aperture.

14 Claims, 3 Drawing Sheets

HYGIENIC SPRAY APPARATUS INTEGRAL WITH TOILET

BACKGROUND OF THE INVENTION

The present invention relates to an apparatus for promoting personal hygiene during use of a toilet and more particularly to a conveniently accessible hygiene apparatus which is integral with a toilet bowl.

Various spray and bidet apparati have been proposed for use in connection with toilets whereby the user may either manually manipulate a handle device having a spray mechanism or whereby a water spray is otherwise ejected within the toilet bowl for purposes of effecting hygienic cleaning during use of the toilet bowl itself. Such prior apparati are disclosed, for example, in EP 101,387; WO 81/02319; U.S. Pat. No. 4,596,058; U.S. Pat. No. 2,344,561; German Patent No. 562,934; and U.S. Pat. No. 4,441,219. These prior devices all involve complex, difficult to use, and inconvenient spray mechanisms which require complex and unsightly piping, hoses, valves and the like which are appended or mounted to or near a toilet bowl or its associated components such as the water tank.

SUMMARY OF THE INVENTION

In accordance with the invention there is provided an improved hygienic spray apparatus for use in connection with a toilet bowl comprising a crescent-shaped shelf integrally protruding from the forward right hand side of a toilet bowl, the shelf and the bowl comprising a unitary body; the toilet bowl comprising a main bowl portion for holding water therein supplied by a first source of water, the main bowl portion having an open top for receiving waste therethrough into the water; the shelf having an aperture in a top surface thereof for mounting a water spray mechanism therein, the water spray mechanism being connected to one end of a flexible hose, the other end of the hose being connected to a second source of water; the shelf forming an enclosed chamber around the outside surface of the main bowl portion of the toilet bowl; the shelf being disposed on the right hand side of the bowl below the rim of the open top such that the water spray mechanism is readily manually accessible by a person sitting over the main bowl for ready removal from the mounting aperture and ready insertion back into the aperture; the hose being readily slidable through the mounting aperture during manual removal and insertion of the water spray mechanism, the chamber enclosably storing the hose out of sight when the water spray mechanism is mounted within the mounting aperture.

The second water source typically constantly feeds water to the water spray mechanism under pressure, the water spray mechanism having a manually actuatable mechanism for readily opening and closing the flow of water through a spray nozzle connected on the water spray mechanism.

The second source of water preferably comprises separate sources of hot and cold water inputs fed into a mechanism for selectively mixing the hot and cold water inputs to output a single flow of water of selected temperature. The hose is preferably connected to a single pipe or tube, the single pipe being disposed beneath a floor on which the toilet bowl is mounted and connected at a remote location to the second source of water.

The apparatus may include a spring loaded wheel mounted within the chamber and on which the flexible hose is wound, the spring load being biased to wind the hose up on the wheel, the hose being readily unwindable from the wheel upon manual removal of the water spray mechanism from the mounting aperture and readily windable back onto the wheel under influence of the spring load.

Further in accordance with the invention, there is provided an improved hygienic spray apparatus for use in connection with a toilet bowl comprising a shelf integrally protruding from the right hand side of a toilet bowl, the shelf and the bowl comprising a unitary body; the shelf comprising a crescent-shaped top surface and a partially egg-shaped lower side surface integrally protruding from the outside surface of the toilet bowl; the top surface of the shelf having an aperture therein for mounting a water spray mechanism therein and slidably receiving a flexible hose connected at one thereof to the water spray mechanism; the toilet bowl comprising a main bowl portion for holding water therein supplied from a first source of water, the main bowl portion having an open top for receiving waste therethrough into water held within the main bowl portion; the shelf forming an enclosed chamber around the outside surface of the main bowl portion; the flexible hose being readily slidable through the mounting aperture and storable out of sight within the enclosed chamber when the water spray mechanism is mounted within the aperture; the shelf being disposed on the right hand outside surface of the toilet bowl below the open top of the main bowl portion for ready manual accessibility to the water spray mechanism by a person sitting over the open top of the main bowl portion.

Most preferably, the apparatus includes a mechanism for gaining ready access to the interior of the chamber formed by the shelf around the main bowl for purposes of enabling ready repair and maintenance within the chamber. The ready access mechanism might comprise a door built into the portion of the unitary apparatus below the egg-shaped lower side surface of the shelf. Alternatively, the access mechanism might comprise a lid formed into the crescent shape of the top surface of the shelf, the top crescent-shaped surface of the shelf being an open crescent-shaped aperture and the lid being mounted over or within such an aperture such that the lid is readily removable and mountable on the shelf.

DETAILED DESCRIPTION OF PREFERRED EMBODIMENTS

Figure 1:
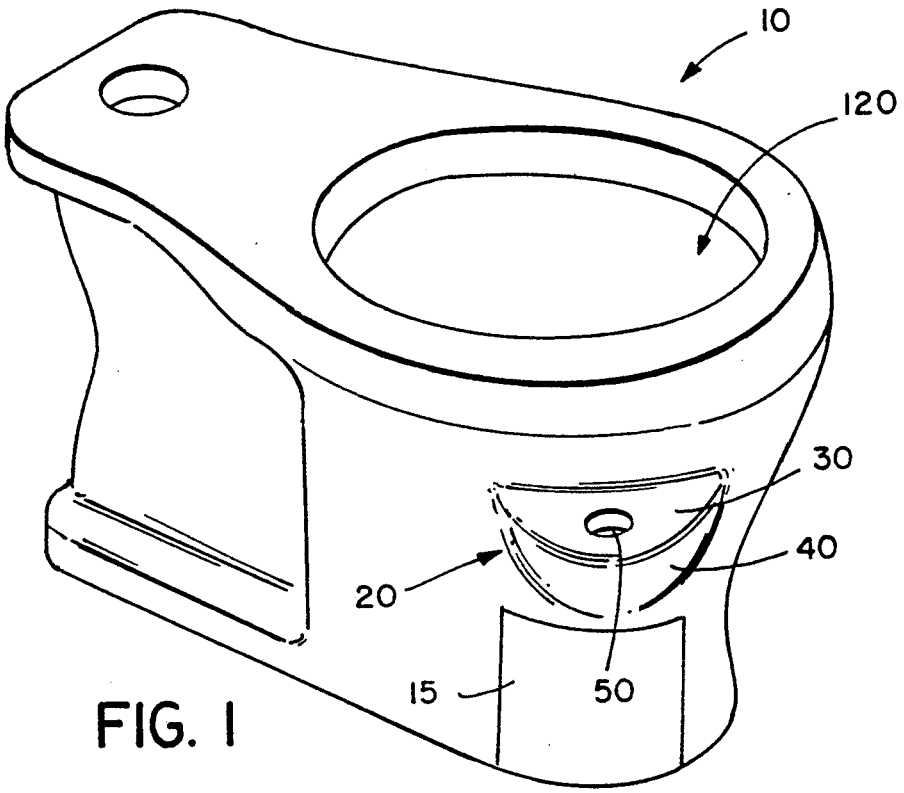
FIG. 1 is an isometric view of a toilet bowl showing an integral shelf mechanism according to the invention.

FIG. 1 shows a toilet bowl 10 having a shelf 20 integrally formed in and protruding from the forward right hand side of the bowl 10. The shelf 20 comprises a crescent-shaped top surface 30 and a partially egg-shaped side surface 40. The shelf 20 and the bowl 10 comprise a unitary body.

Figure 4:
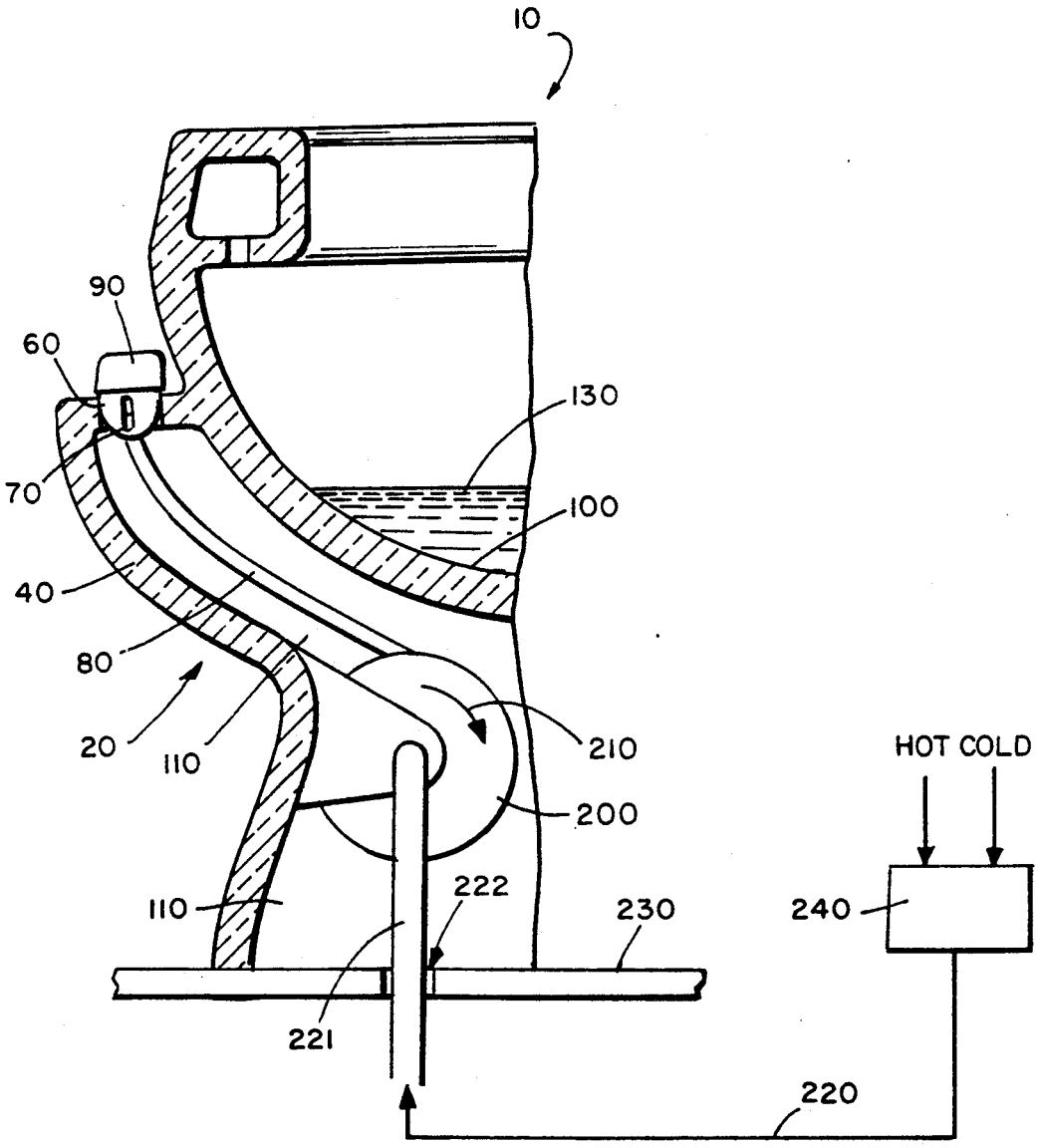
FIG. 4 is a cross-section along lines 4—4 of FIG. 3 including spray and hose mechanisms mounted on the shelf mechanism integrally formed with the toilet bowl.

The shelf 20 includes an aperture 50 in the top surface 30 thereof for mounting a water spray mechanism 60 therein, FIG. 4. The water spray mechanism 60 typically comprises a spray nozzle (not shown) on the top end thereof and preferably a manually actuatable mechanism 70 for opening and closing the flow of water through the spray nozzle on the mechanism 60 through a flexible hose 80. As shown in FIG. 4, the spray mechanism 60 typically includes a cap 90 which fits over the spray nozzle (not shown) on the end of the mechanism 60.

As shown in FIG. 4, the toilet bowl 10 comprises a main waste receipt bowl 100 and the shelf 20 is formed around the outside surface of the forward right hand side of the main bowl 100 such that an empty chamber 110 is formed between the outside surface of the main waste receipt bowl 100 and the inside surface of the walls 40 of the shelf mechanism 20.

The main waste receipt bowl 100 holds water 130 which is fed into and typically maintained in the bowl 100 through a disposal/inlet passage 140. The passage 140 communicates with a first source of supply water, typically held in a tank, (not shown) which supplies and maintains water to the bowl in a conventional manner. Conventional mechanisms for enabling flushing of the water 130 out of the bowl 100 and refilling the bowl 100 with water 130 after flushing are also provided.

The aperture 50 is selected to be of such a size as to prevent the water spray mechanism 60 from passing through the aperture 50 but also to allow the flexible hose 80 to slide readily therethrough. The hose 80 is storable out of sight within chamber 110 when the spray mechanism 60 is mounted in aperture 50. In operation when a person is using the toilet 10, the spray mechanism may be readily manually grasped and pulled upwardly while the user is sitting or standing over the open top 120 of the bowl 100. As the user pulls the mechanism 60 upwardly to a position over the open top 120 of the bowl 100, the flexible hose 80 is pulled along sliding upwardly through the aperture 50. When the user replaces the mechanism 60 in the aperture 50, the hose 80 slides downwardly through the aperture 80 into the chamber 110.

Typically the hose 80 may be inserted within the chamber 110 after use of the mechanism 60 by simply manually replacing the mechanism 60 in the aperture 50, the weight of the hose 80 and the water residing in the hose 80 typically being sufficient to enable ready sliding of the hose 80 through the aperture 50 back into the chamber 110. The flexibility of the hose 80 and the size of the chamber 110 are typically selected such that the entire length of hose 80, typically less than about five feet, may readily accumulate within and remain stored within the chamber 110.

As shown in FIG. 4 in one alternative embodiment, a spring loaded wheel 200 is mounted within chamber 110 on which the hose 80 may be wound up. The wheel 200 is spring biased in the direction shown by arrow 210 for purposes of more readily enabling retraction of hose 80 through aperture 50 into chamber 110 upon completion of use of spray mechanism 60.

For purposes of keeping the mechanisms which feed water to the hose 80 as simple and as elegant as possible, the hose 80 is preferably connected to a single pipe or other tubing 220 which is typically disposed out of sight such as beneath the floor 230 on which the toilet 10 is disposed. The single pipe or tubing 220 is connected at a location remote from the toilet 10 to a second source of input water which is independent of the source of water feeding the bowl 100. Most preferably, the second source of water feeding the piping 220 and hose 80 includes a mechanism for controlling the temperature of the water such as a tempering valve 240 into which hot and cold water are input, FIG. 4. Any conventional tempering valve which allows user control or selection of the degree of hot and cold water mixing may be employed. The temperature control mechanism 240 includes a mechanism for selectively controlling the degree of mixing hot and cold water and the output thereof into tubing 220. The temperature of the water being input to spray mechanism 60 can thus be controlled. Tempering valves such as are available from Central Brass Manufacturing Co., Cleveland, Ohio, e.g. model 555, and Beacon Valves, Waltham, Mass., e.g. an anti-sweat temperator valve, models 600, 640 are suitable.

As shown in the embodiment of FIG. 4, hose 80 is connected to a manifold pipe 221 which forms part of the wheel 200 support structure and simply serves as an intermediate connection between tubing 220 and hose 80. In the more typical embodiment, where a spring loaded wheel mechanism may not be included, the hose 80 is simply directly connected to the tubing 220 at a connection point somewhere out of sight such as within chamber 110 or beneath the floor 230. Typically an end of the tubing 220 would protrude through an aperture 222 in the floor 230 into the chamber 110 whereby one end of the hose 80 might be directly connected to the water delivery tubing 220 in any conventional manner.

As shown in FIG. 4, the chamber 110 extends vertically from about the level of the top surface 30 of the shelf 20 downwardly to the bottom of the toilet bowl 10 where the bowl 10 contacts the floor 230.

Figure 3:
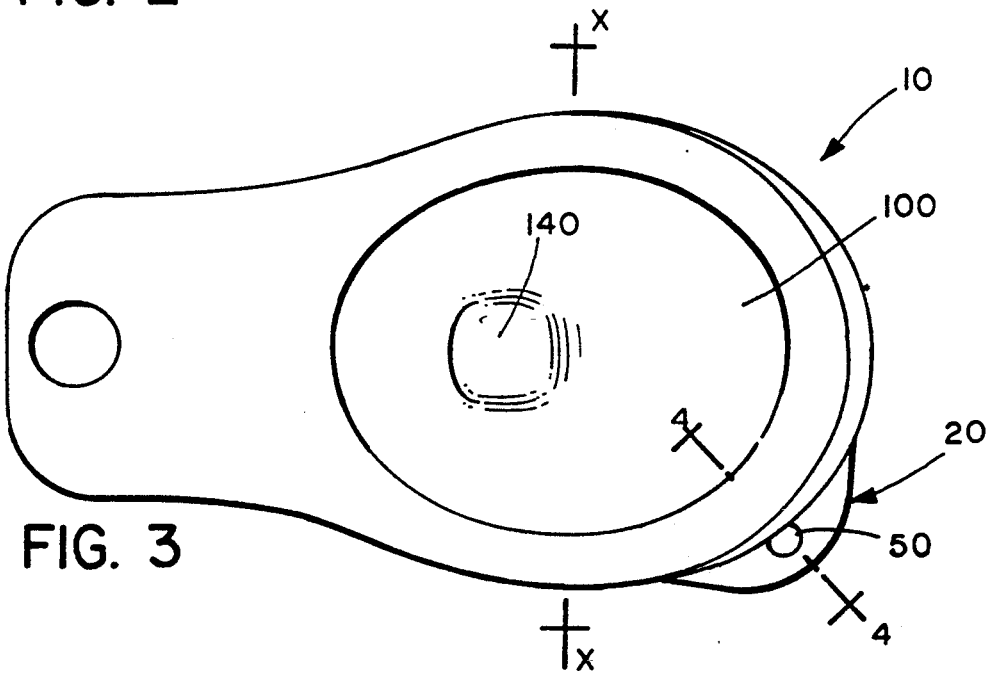
FIG. 3 is a top view of the toilet bowl of FIG. 3.

Most preferably the shelf 20 is disposed on the forward right hand side of the toilet bowl 10, i.e., at least half of the crescent-shaped surface 30 is disposed forwardly of line X—X, FIG. 3, such that the user may have ready access to water spray mechanism 60 when sitting on or over open top 120.

Figure 2:
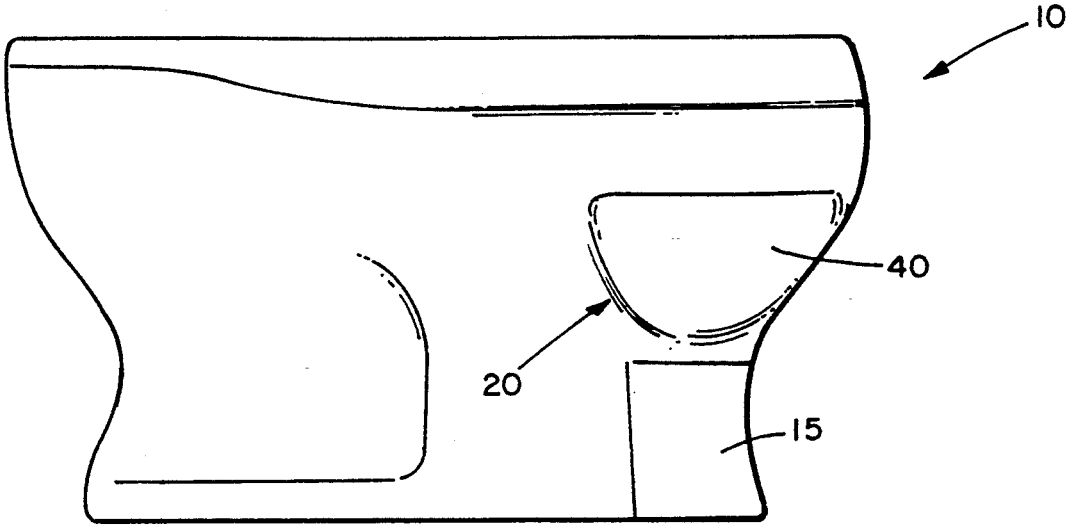
FIG. 2 is a right side view of the toilet bowl of FIG. 1.

As shown in FIGS. 1, 2 a door 15 may be provided within the unitary body 10 below the shelf 20 for purposes of enabling ready access to the interior of chamber 110 such that repair and/or maintenance of the hose 80 and other components within the chamber 110 may be readily effected. Preferably such a door 15 is contoured on its outside surface to the normal contour of the unitary body 10 in the area where the door is specifically mounted. The door 15 may be mounted in any conventional manner such as on hinges (not shown) and include any conventional mechanism for manually pulling the door open such as a knob or aperture (not shown). Alternatively the integral top surface 30 of the shelf 20 may be left open such that a large crescent-shaped aperture is formed on the top of the shelf 20 and a crescent-shaped lid (not shown) which fits in a complementary manner over, around or within such a crescent-shaped aperture may be provided for purposes of enabling ready access to the chamber 110. Such a lid would include the aperture 50 therein for allowing the hose 80 to slide therethrough and for mounting the spray mechanism 60 therein. Such a lid would be readily manually mountable on and removable from the shelf 20.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An improved hygienic spray apparatus for use in connection with a toilet bowl comprising:

a crescent-shaped shelf means integrally protruding from the forward right hand side of a toilet bowl means, the shelf means and the bowl means comprising a unitary body;

the toilet bowl means comprising a main bowl portion for holding water therein supplied by a first source of water, the main bowl portion having an open top for receiving waste therethrough into the water;

the shelf means having an aperture in a top surface thereof for mounting a water spray means therein, the water spray means being connected to one end of a flexible hose, the other end of the hose being connected to a second source of water;

the shelf means forming an enclosed chamber around the outside surface of the main bowl portion of the toilet bowl means;

the shelf means being disposed on the right hand side of the bowl means below the rim of the open top such that the water spray means is readily manually accessible by a person sitting over the remain bowl for ready removal from the mounting aperture and ready insertion back into the aperture;

the hose being readily slidable through the mounting aperture during manual removal and insertion of the water spray means, the chamber enclosably storing the hose out of sight when the water spray means is mounted within the mounting aperture; the apparatus further comprising a door mechanism mounted within the toilet bowl means below the shelf means, the door mechanism being contoured to be continuous with the normal contour of the toilet bowl means.

2. The apparatus of claim 1 wherein the second water source constantly feeds water to the water spray means under pressure, the water spray means having manually actuatable means for readily opening and closing the flow of water through a spray nozzle on the water spray means.

3. The apparatus of claim 1 wherein the second source of water comprises separate sources of hot and cold water inputs fed into a mechanism for selectively mixing the hot and cold water inputs to output a single flow of water of selected temperature.

4. The apparatus of claim 1 wherein the hose is connected to a single piping means, the single piping means being disposed beneath a floor on which the toilet bowl means is mounted and connected at a remote location to the second source of water.

5. The apparatus of claim 1 wherein the second source of water comprises separate sources of hot and cold water inputs fed into a mechanism for selectively mixing the hot and cold water inputs to output a single flow of water of selected temperature.

6. The apparatus of claim 5 wherein the hose is connected to a single piping means, the single piping means being disposed beneath a floor on which the toilet bowl means is mounted and connected at a remote location to the second source of water.

7. The apparatus of claim 3 wherein the hose is connected to a single piping means, the single piping means being disposed beneath a floor on which the toilet bowl means is mounted and connected at a remote location to the second source of water.

8. The apparatus of claim 1 further including a spring loaded wheel means mounted within the chamber and on which the flexible hose is wound, the spring load being biased to wind the hose up on the wheel means, the hose being readily unwindable from the wheel means upon manual removal of the water spray means from the mounting aperture and readily windable back onto the wheel mean under influence of the spring load.

9. An improved hygienic spray apparatus for use in connection with a toilet bowl comprising:

a shelf means integrally protruding from the right hand side of a toilet bowl means, the shelf means and the bowl means comprising a unitary body;

the shelf means comprising a crescent-shaped top surface and a partially egg-shaped lower side surface integrally protruding from the outside surface of the toilet bowl means;

the top surface of the shelf means having an aperture therein for mounting a water spray means therein and slidably receiving a flexible hose means connected at one end thereof to the water spray means and at another end thereof to a first source of water;

the toilet bowl means comprising a main bowl portion for holding water therein supplied from a second source of water, the main bowl portion having an open top for receiving waste therethrough into water held within the main bowl portion;

the flexible hose being readily slidable through the mounting aperture and storable out of sight within the enclosed chamber when the water spray means is mounted within the aperture;

the shelf means being disposed on the right hand outside surface of the toilet bowl means below the open top of the main bowl portion for ready manual accessibility to the water spray means by a person sitting over the open top of the main bowl portion;

the apparatus further comprising a door mechanism mounted within the toilet bowl means below the shelf means, the door mechanism being contoured to be continuous with the normal contour of the toilet bowl means.

10. The apparatus of claim 9 wherein the other end of the flexible hose is connected to a second source of water selectively controllable in temperature.

11. The apparatus of claim 9 wherein the flexible hose is connected to a piping means which in turn is connected to a second source of water at a location remote from the toilet bowl means, the piping means connected between the flexible hose means and the second source of water being hidden from view beneath a floor on which the toilet bowl means is mounted.

12. The apparatus of claim 10 wherein the flexible hose is connected to a piping means which in turn is connected to a second source of water at a location remote from the toilet bowl means, the piping means connected between the flexible hose means and the second source of water being hidden from view beneath a floor on which the toilet bowl means is mounted.

13. The apparatus of claim 9 wherein the second source of water comprises separate sources of hot and cold water inputs fed into a mechanism for selectively mixing the hot and cold water inputs to output a single flow of water of selected temperature.

14. The apparatus of claim 13 wherein the hose is connected to a single piping means, the single piping means being disposed beneath a floor on which the toilet bowl means is mounted and connected at a remote location to the second source of water.

* * * * *